United States Patent [19]

Lessard et al.

[11] 4,438,632

[45] Mar. 27, 1984

[54] MEANS FOR PERIODIC DESORPTION OF A CRYOPUMP

[75] Inventors: Philip A. Lessard, Acton; Allen J. Bartlett, Milford, both of Mass.

[73] Assignee: Helix Technology Corporation, Waltham, Mass.

[21] Appl. No.: 395,120

[22] Filed: Jul. 6, 1982

[51] Int. Cl.[3] ..... B01D 5/00

[52] U.S. Cl. ..... 62/55.5; 55/269; 62/383; 165/32; 417/901

[58] Field of Search ..... 62/55.5, 383; 165/32; 55/269; 417/901

[56] References Cited

U.S. PATENT DOCUMENTS

| | | | |
|---|---|---|---|
| 3,229,755 | 1/1966 | Komarow . | |
| 3,256,706 | 6/1966 | Hansen . | |
| 3,338,063 | 8/1967 | Hogan et al. | 62/383 |
| 3,364,654 | 1/1968 | Westbrock . | |
| 3,399,717 | 9/1968 | Cline . | |
| 3,478,819 | 11/1969 | Reinke . | |
| 3,512,369 | 5/1970 | Houyvet et al. | 62/383 |
| 3,579,998 | 5/1971 | Thibault et al. | 62/55.5 |
| 3,717,201 | 2/1973 | Hosmer et al. . | |
| 3,721,101 | 3/1973 | Sheppard et al. | 62/383 |
| 4,009,585 | 3/1977 | Larin . | |
| 4,072,025 | 2/1978 | Thibault . | |

FOREIGN PATENT DOCUMENTS

| | | |
|---|---|---|
| 1938035 | 2/1970 | Fed. Rep. of Germany . |
| 2065782 | 7/1981 | United Kingdom . |

OTHER PUBLICATIONS

B. Denhoy et al., "Degassing a Large LHe Cryopump," Lawrence Livermore Laboratory, University of California, n.d.

*Primary Examiner*—Ronald C. Capossela

*Attorney, Agent, or Firm*—Hamilton, Brook, Smith & Reynolds

[57] ABSTRACT

The invention discloses a cryopump comprising a primary cryopanel 67 associated with a low temperature heat sink 60 having means for adsorbing a first low boiling point gas and a secondary cryopanel 80 associated with heat sink 60 and a higher temperature heat sink 48 having means for condensing a higher boiling point gas. There are means 90 for selectively conducting heat to the primary cryopanel to raise the temperature of the cryopanel above that which is necessary to cause said first gas to become desorbed from said cryopanel while having minimal effect on the capacity of the higher temperature heat sink.

7 Claims, 2 Drawing Figures

MEANS FOR PERIODIC DESORPTION OF A CRYOPUMP

DESCRIPTION

1. Technical Field

This invention relates to the production of high vacuum by cryogenic freezing of gases and more particularly to means for selectively removing excess gases which have been adsorbed in a cryopump.

2. Background of the Invention

"Cryopumping" or "cryogenic pumping" is the technique of producing low pressures within an enclosed vessel by condensing or adsorbing the gases within the vessel on surfaces cooled to cryogenic temperatures. Cryopumping generally takes place in two or more stages. Gases called Type I gases including water vapor, carbon dioxide and halogens among others with moderately low boiling points are frozen on first stage cryopanels cooled to temperatures of approximately 100° K.

Gases with lower boiling points, called Type II gases including nitrogen and argon among others are frozen onto second stage cryopanels cooled to approximately 20° K.

The lowest boiling point gases, including hydrogen, helium and neon called Type III gases, are cryogenically adsorbed on adsorbents such as molecular sieve or activated charcoal which are attached to surfaces in the form of a box or trap and cooled to temperatures below 20° K. The box or trap is often referred to as the primary pumping surface or primary cryopanel.

Cryopumps have found particular usage by being attached to chambers in which operations are to be preformed requiring very low pressures. Examples of such operations include the deposition of metallic and non-metallic films having specific electrical or optical properties. These films are used in the semiconductor industry in the manufacture of integrated circuits and in the optical industry in the manufacture of lenses, filters and mirrors. In many such processes, hydrogen is liberated as a by-product of water-metal reactions or by ionization of water vapor. The capacity of typical cryopumps for Type III (cryosorbed) gases such as hydrogen is generally much less than for the Type I or Type II gases, which are frozen. Consequently, the adsorbent in the pump becomes saturated after a relatively few number of hours of operation. In order to renew the adsorbent capacity, the adsorbent must be warmed and the cryosorbed gases devolved. This regeneration is normally accomplished by inactivating the cryopump and warming it. The gases evolved as the pump warms are removed by secondary pumping means.

However, insofar as the operation being performed is concerned, this is down time. The down time for regeneration, as the process is called, is frequently as long as the time that the cryopump is operative prior to saturation.

This invention is particularly directed to a means for removing hydrogen from a sorbent substantially reducing the down time of the cryopump.

DISCLOSURE OF THE INVENTION

Hydrogen and/or other low boiling point gases which have saturated an adsorbent cryopanel of a multi-stage cryopump can be removed by selectively causing the gas to be desorbed from the primary cryopanel without causing sublimation of the higher boiling point gases from the secondary cryopanel. This is accomplished in a typical cryopump which comprises a primary cryopanel associated with a low temperature heat sink having means for adsorbing a first low boiling point gas. There is a second cryopanel (or cryopanels) which is associated with a higher temperature heat sink. It has means for condensing a second higher boiling point gas. The cryopump has means for selectively transferring heat to the primary cryopanel to raise the temperature of the cryopanel above that which is necessary to cause said gas to become desorbed from the cryopanel. The selective desorption process is so controlled that it does not substantially add heat to the secondary cryopanel. Accordingly, it does not cause sublimation of the higher boiling point gas or gases from that secondary cryopanel.

The means for conducting heat to the primary cryopanel is a conductive rod movable selectively into and out of engagement with the low temperature heat sink associated with the primary cryopanel.

The desorbed gas, as for example hydrogen, is removed from the system by a secondary pumping means which may be, for example, a nonevaporable getter pump which may be located off-line in order that it too may be purged of excess gas while the cryopump and the process are in operation thereby not causing any down time.

PREFERRED EMBODIMENT OF THE INVENTION

Figure 1:
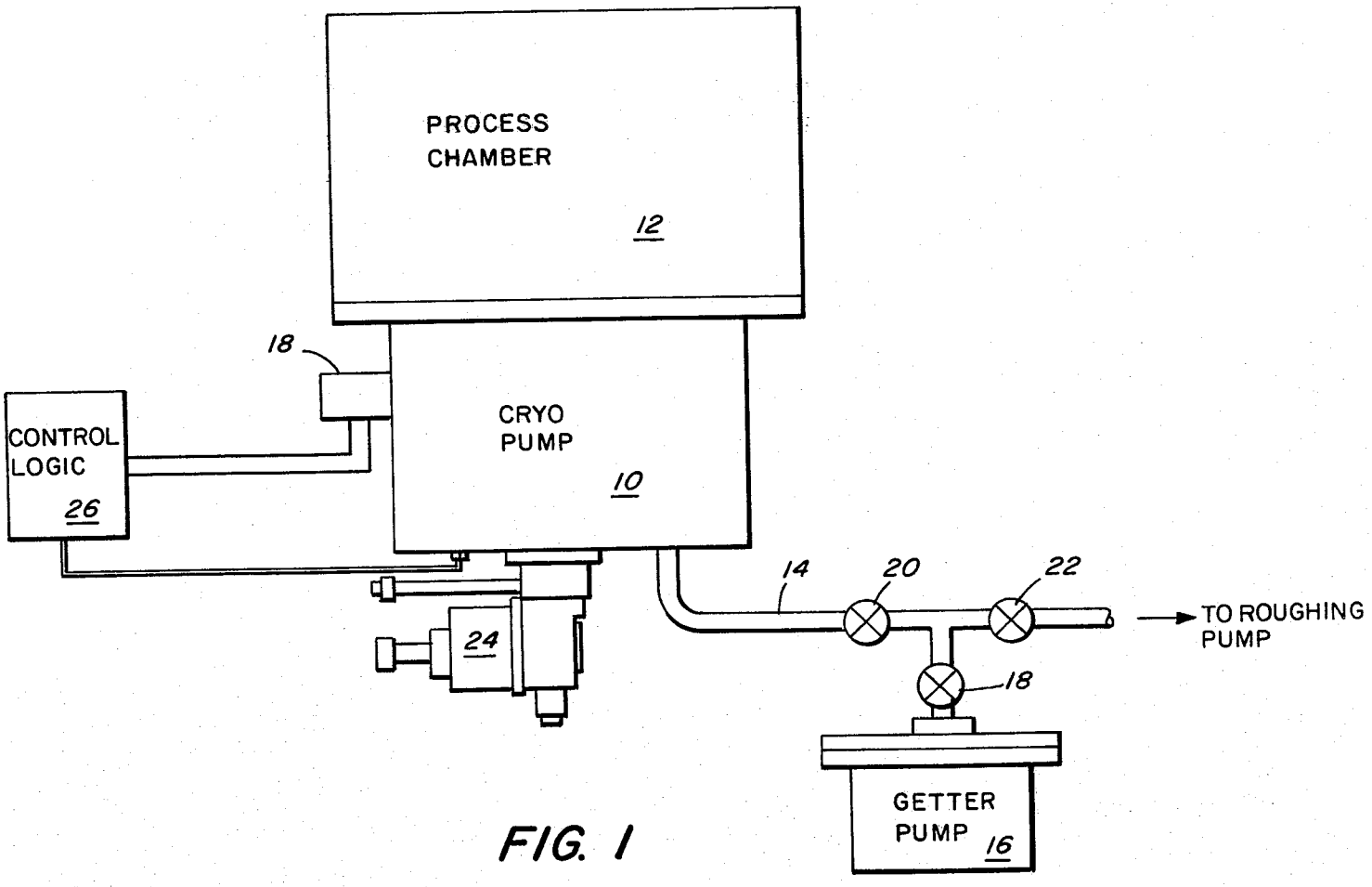
FIG. 1 is a schematic side elevation of a system embodying the present invention which includes a multi-stage cryopump, a process chamber, a nonevaporable getter pump and its associated valve control mechanism.

Referring to FIG. 1 there will be seen a 20 cryopump 10 connected directly to a work processing chamber 12. Tubulation 14 leads to a roughing pump (not shown). A nonevaporable getter pump 16 or other equivalent pumping means communicates with the cryopump 10 by way of the tubulation 14. A shutoff valve 18 is interposed between the getter pump and the tubulation 14 while shutoff valves 20 and 22 are located between the getter pump 16 and the cryopump 10 and the getter pump and the roughing pump respectively. The cryopump is driven by a motor 24. A control logic 26 is connected to a temperature sensor not seen in FIG. 1 but located within the cryopump and to a housing 28 of a heat conducting mechanism movable within the cryopump 10.

Figure 2:
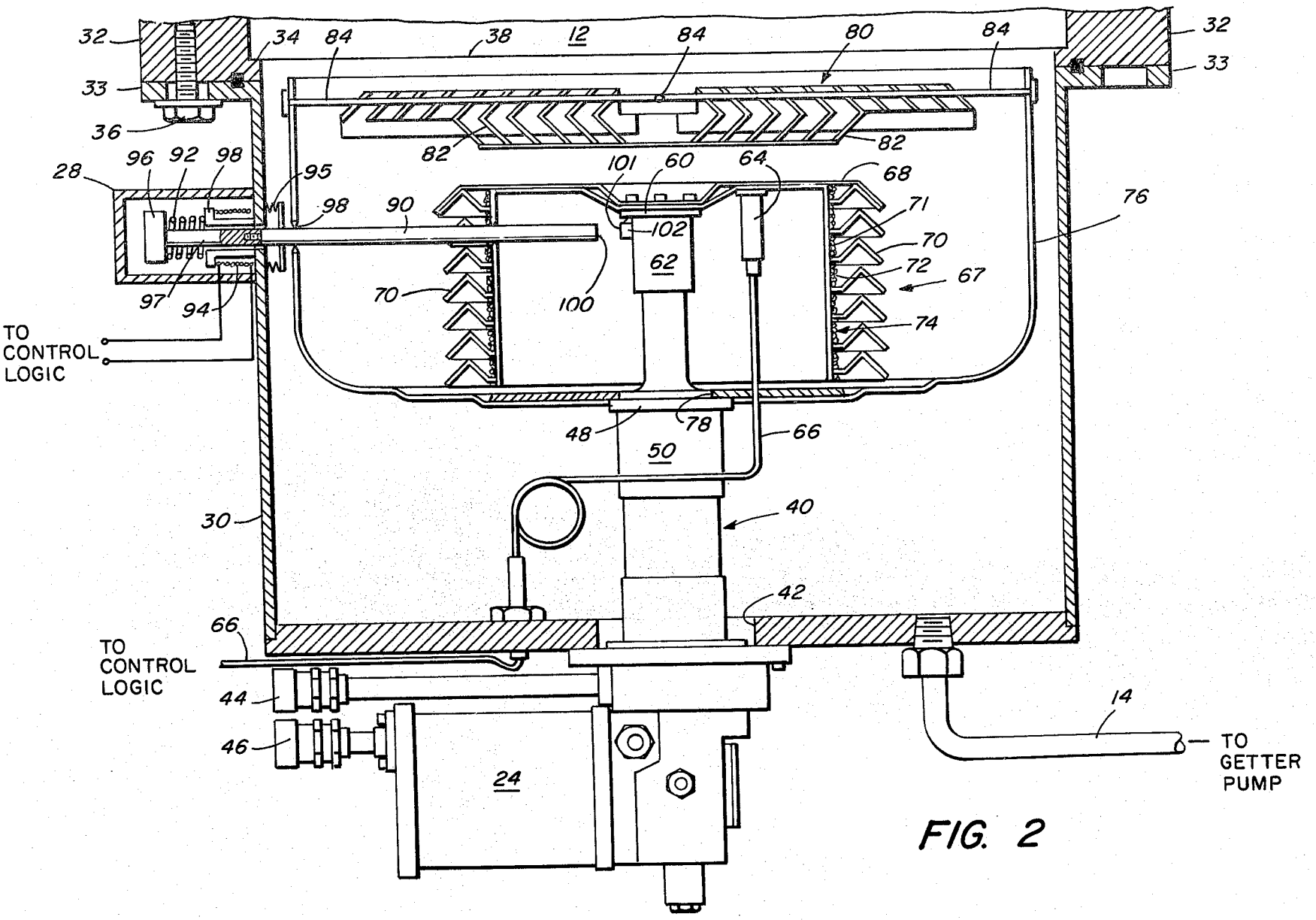
FIG. 2 is a side elevation partly in section of the multi-stage cryopump equipped with heat conducting means associated with the primary cryopanel.

Details of the cryopump are best seen in FIG. 2. The pump includes a main housing or wall 30 which is mounted to the wall 32 of the work processing chamber 12 by means of a circular flange 33 and is secured to a mating flange 34 by a plurality of bolts 36 (only one of which is shown). A circular opening 38 in the flange 34 permits communication between the process chamber 12 and the cryopump 10.

A two-stage cold finger 40 of a refrigerator protrudes into the housing 30 through an opening 42. In this case, the refrigerator is a Gifford-McMahon type. However, other types of refrigerators may be used if it be so desired. A two-stage displacer in the cold finger 40 is driven by the motor 24. With each cycle, helium gas is introduced into the cold finger 40 under pressure through a line 44. It is expanded and thus cooled and then exhausted through a line 46. Such a refrigerator is disclosed in U.S. Pat. No. 3,218,815 to Chellis et al.

A first stage heat sink or heat station 48 is mounted at the cold end of the first stage 50 of the refrigerator cold finger 40. Similarly, a heat sink 60 is mounted on the cold end of the second stage 62 of the refrigerator cold finger. A suitable temperature sensor element 64 is mounted adjacent to the heat sink 64. A line 66 connects it to the control logic 26 (FIG. 1) outside the cryopump.

The second stage array pumping surface or cryopanel indicated generally as 67 is a circular array mounted on the heat sink 60. This panel comprises a disc 68 and a set of circularly arranged chevrons 70 arranged in a vertical array and mounted to the disc 68. A trap 71 comprising an outer cylindrical surface 72 holds a low temperature sorbent such as activated charcoal 74. Access is gained to this sorbent by low boiling point gases through the chevrons 70 (See FIG. 2). Surface 70 and the adsorbent 74 can be loosely termed the primary low temperature cryopanel.

A cup-shaped radiation shield 76 is mounted to the first stage, high temperature heat sink 48. The second stage 62 of the cold finger 40 extends through an opening 78 in the radiation shield. The shield 76, which surrounds the primary cryopanel 67 to the rear and sides, minimizes heating of the primary cryopanel by radiation.

A frontal cryopanel 80 serves as both a radiation shield for the primary cryopanel 67 and as a cryopumping surface for higher boiling temperature Type I gases such as water vapor. This panel comprises a circular array of concentric louvres and chevrons 82 joined by spoke-like rods 84 fixed in the shield 76. The configuration of this array need not be confined to circular concentric components. However, it should be an array of baffles so arranged as to act as a radiant heat shield and a higher temperature cryopumping panel while providing a path for lower boiling temperature gases to the primary cryopanel 67. The shield 76 must be sufficiently enlarged to permit unobstructed flow of gases to the primary cryopanel within the heat shield.

The low boiling point gas desorbing means includes the housing 28 within which there is a high conductivity (preferably copper) heat bar 90 mounted for sliding movement through the wall 30 of the cryopump. A spring 92 is compressed between a solenoid 94 and the head 96 of a ferromagnetic portion 97 threaded onto the heat bar 90. The bar passes through a bellows seal 95 and the radiation shield 76, being guided by a knife edge low conductivity guide 98. In like manner, it passes through the primary pumping surface 67. Its innermost end 100 is engagable with a flatheaded boss 102 on the second stage 62 of the cold finger 40 in thermal communication with the heat sink 60.

The solenoid 94 surrounds the ferromagnetic portion of the heat bar 90 to the right of the head 96 as viewed in FIG. 2. When the solenoid is actuated, in a manner to be explained in more detail hereinafter, the ferromagnetic portion of the heat bar 90 is drawn to the right, moving the bar with it through the wall 30 of the cryopump and the heat shield 76, until the flat end 100 of the bar engages the flat face 101 of the boss 102. This permits heat from outside the cryopump wall 30 to be conducted through the bar directly to the second stage 62 of the refrigerator without significantly raising the temperature of the shield 76 thus without causing an appreciable temperature rise in the high temperature stage of the cryopump. Heating the primary cryopanel to about 40° K. causes the hydrogen or other gas on the primary pumping surface to be desorbed, the gas or gases having previously been adsorbed at from 10° to 25° K.

The temperature sensor 64 connected to the control logic 26 is in position to detect temperature changes within the cryopump and thereby to deactivate the solenoid before the additional thermal load due to gas conduction caused by the devolved gas exceeds the capacity of the pump.

The mechanism functions in the following manner: Before the cryopump begins to operate, the valve 18 leading to the getter pump 16 is initially closed while valves 20 and 22 are opened to permit the roughing pump to begin to evacuate the cryopump and the processing chamber 12 which are initially at atmospheric pressure. When a predetermined partial vacuum is reached, valves 20 and 22 are closed and the roughing pump turned off. The cryopump motor 24 is then turned on. The first stage of the refrigerator cools the secondary pumping surfaces down to approximately 70° K. causing the relatively high boiling point Type I gases, such as water vapor, to become condensed on the pumping surfaces of the secondary cryopanel.

The second stage continues to be cooled down to approximately 10° to 25° K. causing Type II gases such as nitrogen and argon to be deposited on the cold stage array 67 and causing Type III gases such as hydrogen and neon to begin to become adsorbed in the activated charcoal sorbent. When the process chamber 12 reaches a predetermined pressure, operation may commence in the chamber. For purposes of illustration, it will be assumed that the process involves aluminum sputtering where aluminum is evaporated onto a workpiece. The presence of water vapor produces hydrogen gas by reaction with the aluminum. The hydrogen gas thus being produced along with other gases originally in the pump 10 and the chamber 12 begin to become adsorbed by the activated charcoal. Because the hydrogen is being produced continuously, and because the total capacity is limited by the amount of charcoal or other adsorbents present; subsequently the sorbent becomes saturated and the pressure within the process chamber begins to increase making it impractical to continue.

Before applicant's invention, it was the normal practice to stop the process and turn off the cryopump to allow the temperature to rise, thus allowing the adsorbed gases to revert to their gaseous state whereupon they were pumped out of the process chamber and the cryopump.

However, in accordance with applicant's invention, while the process chamber is being loaded and the cryopump 10 is isolated from the process chamber 12, the solenoid 94 is actuated to move the heater bar 90 into engagement with the boss 102 on the heat sink 62. The cryopump, however, need not be turned off allowing the first stage, i.e., the secondary pumping surfaces 80, to be continuously cooled to about 70° K. However, the heater bar remains in contact with the boss 102 until the second stage or primary pumping surfaces become heated to approximately 40° K. which causes the hydrogen to be desorbed from the adsorbent.

During this process, valves 18, 20 and 22 are closed. Valves 18 and 20 are then opened, either by automatic control means or manually if it be so desired. The getter pump 16 is then allowed to pump the hydrogen which has been desorbed from the adsorbent 74.

A pressure sensor will signal when the pressure within the pump 10 has fallen to a predetermined level indicating that the hydrogen has been removed. During this time, the process chamber may be recycled by the operator.

The heater bar 90 is then withdrawn from the boss 102 by the opening 92, by the solenoid 94 being turned off either by the control logic 26 or manually if so desired. Valve 20 leading to the getter pump is closed. The second stage of the refrigerator then proceeds to cool down below 40° K. toward 10° K. causing whatever remaining gases there are in the pump to be adsorbed on the charcoal. Ultimately the entire system reaches a pressure where it again becomes suitable to reinstitute the work process within the chamber.

Since the getter pump is only employed intermittently and is closed off from the system, it can be regenerated at will. Since this is done "off-line," it does not interfere with the process cycle. The periodic regeneration of the cryopump assures that the time for the sorbent to become saturated and require a total regeneration is substantially extended.

We claim:

1. A cryopump comprising:

a primary cryopanel within the cryopump associated with a low temperature heat sink having means for adsorbing a first low boiling point gas, a secondary cryopanel associated with a higher temperature heat sink having means for condensing a higher boiling point gas, characterized by:

movable means for selectively conducting heat from outside the cryopump to the primary cryopanel within the cryopump to raise the temperature of the cryopanel above that which is necessary to cause said first gas to become desorbed from said cryopanel.

2. A cryopump comprising:

a primary cryopanel within the cryopump associated with a low temperature heat sink having means for adsorbing a first low boiling point gas, a secondary cryopanel associated with a higher temperature heat sink having means for condensing a higher boiling point gas or gases characterized by:

movable means adapted to be actuated during the operation of the cryopump to cause heat energy to be directed from outside the cryopump to the primary cryopanel within the cryopump to cause said first low boiling point gas to be desorbed from the primary cryopanel without causing sublimation of the higher boiling point gas from the secondary cryopanel.

3. A cryopump comprising:

a primary cryopanel within the cryopump associated with a low temperature heat sink having means for adsorbing first low boiling point gas, a secondary cryopanel associated with a higher temperature heat sink having means for condensing a higher boiling point gas, characterized by:

movable means for selectively causing external heat from outside the cryopump to flow to the primary cryopanel within the cryopump said first gas to become desorbed from said cryopanel and external pump means for removing said desorbed first gas from said cryopump.

4. A cryopump according to claim 1 wherein the means for conducting heat is a conductive rod movable selectively into and out of engagement with said low temperature heat sink.

5. A cryopump according to claim 2 or 3 wherein the means for causing said first low boiling point gas to be desorbed is a heat conducting rod movable into and out of engagement with said low temperature heat sink.

6. A cryopump according to claim 3 wherein the external pump means is a non-evaporable getter pump.

7. A cryopump comprising:

a primary cryopanel within the cryopump associated with a low temperature heat sink having means for adsorbing a first low boiling point gas, a secondary cryopanel associated with a higher temperature heat sink having means for condensing a second higher boiling point gas, a heat conducting rod extending from outside the cryopump and movable selectively into and out of engagement with said low temperature heat sink to cause heat energy to be directed from outside the cryopump to the low temperature heat sink to cause said first gas to be desorbed from said cryopanel and, external pump means for removing desorbed first gas from said cryopump.

* * * * *